US005209165A

United States Patent [19]

Foan

[11] Patent Number: 5,209,165

[45] Date of Patent: May 11, 1993

[54] BUFFER STOP

[75] Inventor: Andrew R. Foan, Bramcote, England

[73] Assignee: Bicc Public Limited Co., England

[21] Appl. No.: 781,067

[22] Filed: Oct. 18, 1991

[51] Int. Cl.[5] ..... B61K 7/18

[52] U.S. Cl. ..... 104/259; 104/26.2; 188/62

[58] Field of Search ..... 104/26.2, 249, 254, 104/257, 258, 259; 188/36, 63, 62, 43

[56] References Cited

U.S. PATENT DOCUMENTS 3,204,576 9/1965 Wilisch et al. ..... 104/259
4,168,664 9/1979 Wilisch ..... 104/259

FOREIGN PATENT DOCUMENTS 3443480 6/1986 Fed. Rep. of Germany ..... 104/259

*Primary Examiner*—Mark T. Le
*Attorney, Agent, or Firm*—Anthony J. Casella; Gerald E. Hespos

[57] ABSTRACT

In a friction buffer stop, each side wall of the buffer structure has at its lowermost edge mutually spaced slots extending parallel to the adjacent rail, each slot being directly opposite to and of the same length as a slot in the other side wall. Pairs of transversely spaced two-part clamps detachably secure each side wall to the rails. Each clamp comprises a pair of side plates clamped on opposite sides of the rail by a clamping bolt passing through one of the mutually spaced slots. The slots engaged by the bolts of each pair of clamps are identical in length; and the slots engaged by the bolts of each pair of clamps, except the first pair of clamps, are longer than slots engaged by the bolts of an adjacent upstream pair of clamps. On impact of a train with the buffer stop, in turn the side plates of the pairs of clamps slide with respect to the rails and cause the energy of the train to be absorbed by gradually increasing frictional resistance between the relatively sliding contacting surfaces of the rails and side plates of the clamps.

9 Claims, 5 Drawing Sheets

2
21
22
22
24
4
27
27
25
24
R

BUFFER STOP

BACKGROUND AND SUMMARY OF THE INVENTION

This invention relates to buffer stops for use on the permanent tracks of railways and is particularly concerned with buffer stops of the kind which include means for imparting a frictional braking force to a train which has made an impact with the buffer stop.

It is an object of the invention to provide a simple and inexpensive buffer stop of the aforesaid kind which, on impact of a train with the buffer stop, will provide a frictional braking force which progressively increases as the train is gradually brought to a standstill, thereby substantially reducing risk of any sudden jerk on initial impact with the buffer stop.

According to the invention, the improved buffer stop comprises a buffer structure including a pair of transversely spaced side walls each adapted to extend lengthwise of and adjacent to one rail of the permanent track of a railway and having spaced from its, lowermost edge a plurality of slots mutually spaced along the length of the side wall, each slot of one side wall extending substantially parallel to the adjacent rail and being directly opposite to and of substantially the same length as a substantially identical slot in the other side wall, and a plurality of pairs of transversely spaced two-part clamps for detachably securing the side walls of the buffer structure to the rails of the permanent track at spaced positions along the lengths of the side walls, each two-part clamp of each pair comprising a pair of plates which are disposed on opposite sides of one side wall of the buffer structure and are adapted to be clamped in direct contact with opposite sides of the adjacent rail by at least one clamping bolt which passes through one of the mutually spaced slots in said wall, the slots engaged by the bolts of the two-part clamps of each pair of clamps being substantially identical in length and the slots engaged by the bolts of the two-part clamps of each pair of clamps, except the first and upstream pair of clamps at the upstream end of the buffer structure, being greater in length than the slots engaged by the bolts of the two-part clamps of an adjacent upstream pair of clamps; whereby, on impact of a train with the buffer stop, the side walls of the buffer structure will move a first predetermined distance with respect to the permanent track so that the upstream end walls of the slots engaged by the bolts of the two-part clamps of the pair of clamps at said upstream end of the buffer structure will directly or indirectly abut said bolts to cause the side plates of said two-part clamps to slide with respect to the rails of the permanent track and to cause the energy of the train to be absorbed by frictional resistance between the relatively sliding contacting surfaces of the rails and side plates of the clamps, and the side walls of the buffer structure will move at least one further predetermined distance with respect to the permanent track, the or each further predetermined distance being of a greater length than the preceding predetermined distance, so that the upstream end walls of the slots engaged by the bolts of the two-part clamps of the or each succeeding pair of clamps will directly or indirectly abut said bolts to cause the side plates of said succeeding pair of clamps to slide with respect to the rails of the permanent track and to cause further energy of the train to be absorbed by frictional resistance between the relatively moving contacting surfaces of the rails and side plates of said succeeding pair of clamps in addition to that being absorbed by the frictional resistance between the relatively moving contacting surfaces of the rails and side plates of the or each preceding pair of clamps.

Preferably, each of the slots in each side wall of the buffer structure through which a clamping bolt passes is of such a length that, when the buffer stop is initially installed and before impact by a train, each bolt is in direct or indirect contact with the downstream end of the slot in which it is engaged. By virtue of this arrangement, after a train has made impact with the buffer stop and has been withdrawn, the buffer stop can be readily re-installed in its original position by loosening the clamping bolts, moving the buffer structure with respect to the permanent track until the bolts directly or indirectly abut the downstream end walls of the slots in which they are engaged, and then tightening the bolts, the buffer stop thereby automatically being re-installed in its correct position.

Each two-part clamp of each pair of clamps for detachably securing the side walls of the buffer structure to the rails of the permanent track may have a single clamping bolt passing through one of the slots in the adjacent side wall of the buffer structure but, preferably, each two-part clamp has a plurality of bolts mutually spaced along the length of the clamp and passing through a like plurality of mutually spaced slots in the side wall of the structure, each of the same length as one another, so that, when impact of a train with the buffer stop occurs and the side walls of the buffer structure move with respect to the permanent track, the upstream end walls of said plurality of slots abut the bolts passing therethrough simultaneously.

Preferably, at least one of the side plates of each two-part clamp of each pair of clamps has at least one transversely extending lug which passes through a slot in the associated side wall of the buffer structure and engages with the other side plate of said clamp and said clamping bolt passes through a transversely extending bore in said lug so that, when the side walls of the buffer structure move with respect to the permanent track when a train makes impact with the buffer stop, the upstream ends of said slots in the side walls will make direct contact with the transversely extending lugs of the clamps through which the clamping bolts pass. The or each transversely extending lug of each two part clamp of each pair of clamps preferably is of substantially circular cross-section and, in this case, preferably the upstream end wall of the slot through which the lug passes is of corresponding substantially semi-circular shape, thereby providing efficient means of resisting the applied loads.

In a preferred embodiment, each side plate of each two-part clamp of each pair of clamps has at least one transversely extending lug of substantially semi-circular cross-section which passes through a slot in the associated side wall of the buffer structure and co-operates with the semi-circular lug of the other side plate of the clamp to form a two-part lug of substantially circular cross-section. Preferably, the abutting diametrical faces of the lugs of semi-circular shape lie in a plane that will be approximately parallel to the plane containing the uppermost surfaces of the rails of the permanent track.

The axis of the transversely extending bore in the or each lug through which the clamping bolt passes may be co-linear with the axis of the lug but, to enhance clamping of the side plates of the clamp to the adjacent rail of the permanent track, preferably the axis of the transversely extending bore through the or each lug is inclined at an acute angle to the axis of the lug and substantially parallel to the preferred direction of the force to be imparted on the side plates to clamp them to the rail.

In addition to the advantages hereinbefore described, the improved buffer stop has the important advantage that it can be readily adapted to accommodate the impact of a train of any speed and load within wide limited ranges of speed and load by the provision of an appropriate number of pairs of two-part clamps. Furthermore, the buffer structure can be readily modified to accommodate any section of rail by use of side plates of appropriate shapes. Moreover, installation and re-positioning of the buffer structure can be readily effected because the two-part clamps are secured to and carried by the side walls of the buffer structure.

BRIEF DESCRIPTION OF THE DRAWINGS

The invention is further illustrated by a description, by way of example, of a preferred buffer stop for use on the permanent track of a railway with reference to the accompanying drawings, in which.

DETAILED DESCRIPTION OF THE PREFERRED EMBODIMENT

Figure 1:
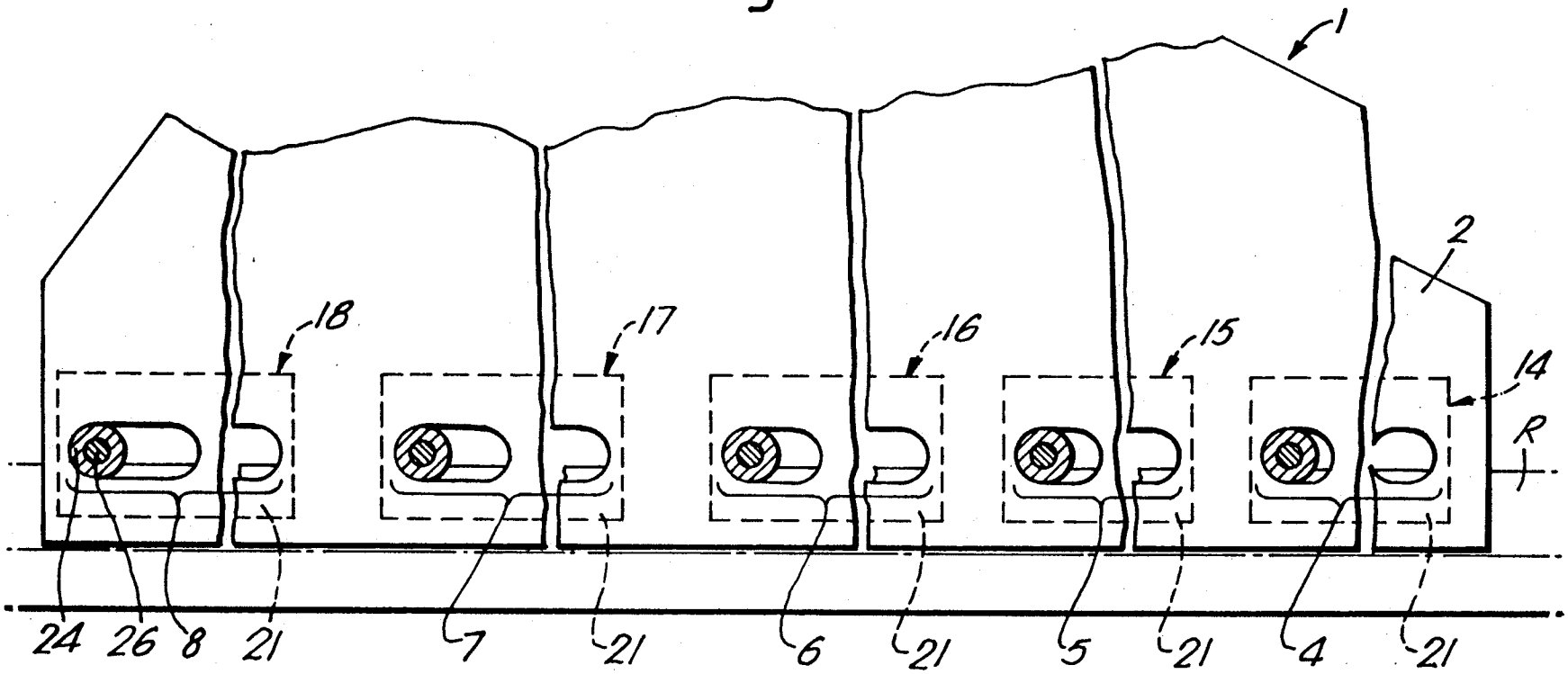
FIG. 1 is a diagrammatic fragmental side view of one side wall of the preferred buffer stop with the side plates of the two-part clamps on one side of the side wall omitted.
Figure 2:
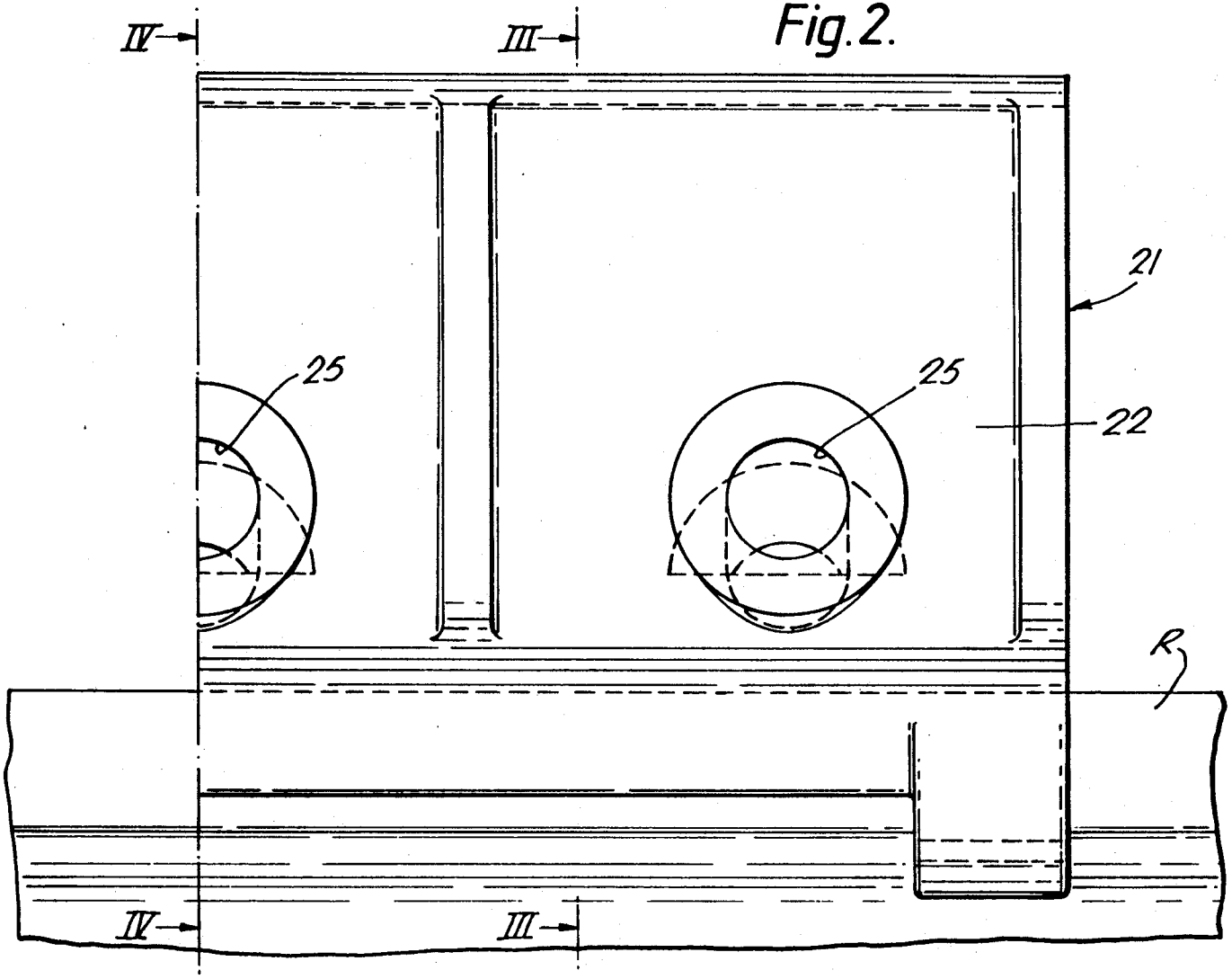
FIG. 2 is a half-side view of one side plate of a two-part clamp of the preferred buffer stop.
Figure 5:
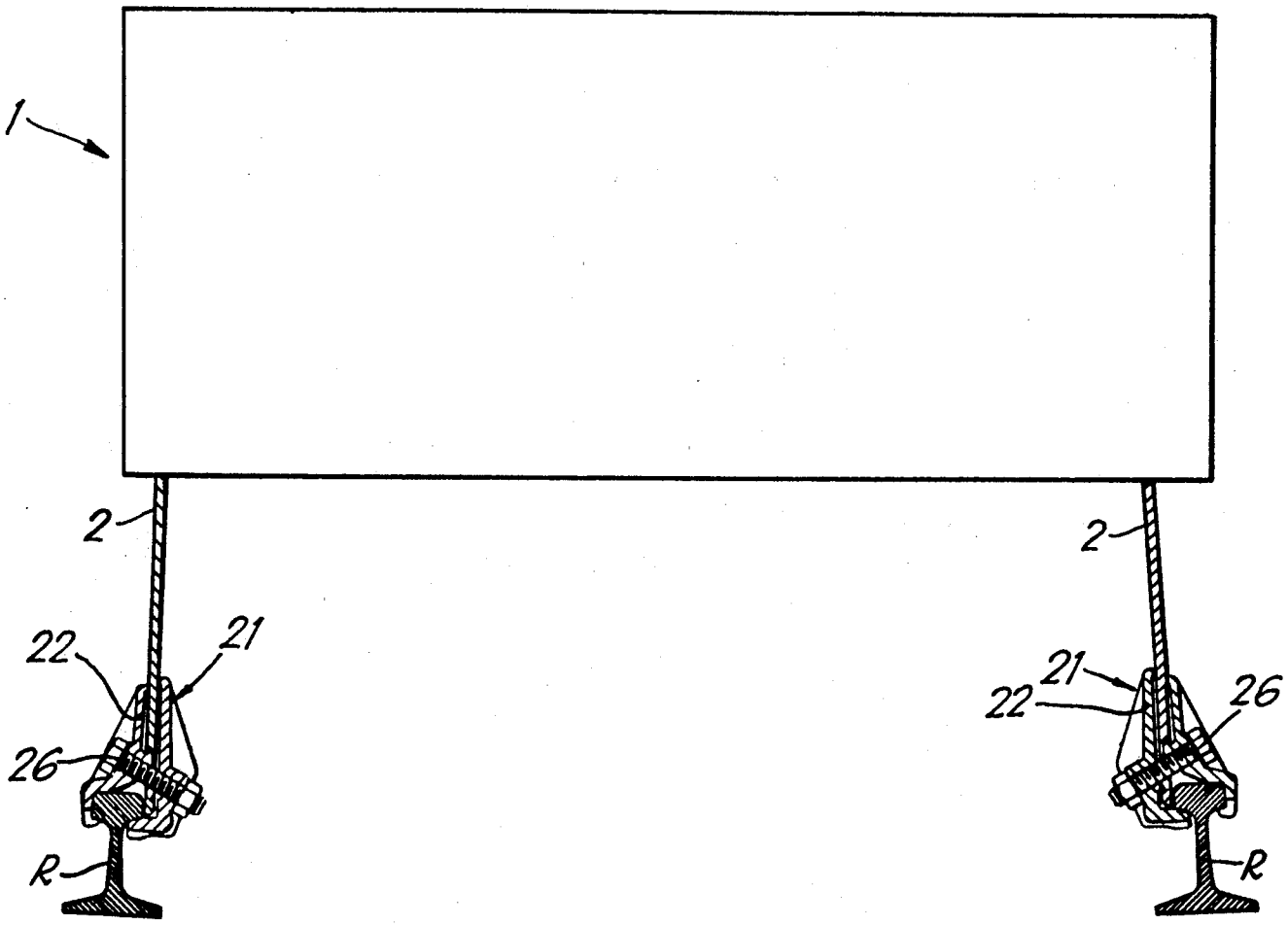
FIG. 5 is a front end view of the preferred buffer stop shown partly in section and partly in elevation.

As shown in FIGS. 1 and 5, the preferred buffer stop comprises a buffer structure 1 including two transversely spaced substantially identical side walls 2 each extending lengthwise of and adjacent to one rail R of two-rail permanent track of a railway. Each side wall 2 has spaced from its lower edge a plurality of slots at spaced positions along the length of the side wall subdivided into five groups 4, 5, 6, 7 and 8 of three slots in each group. Each slot of each group 4, 5, 6, 7 and 8 of slots of one side wall 2 extends parallel to the adjacent rail R and is directly opposite to and of the same length as an identical slot in the corresponding group of slots in the other side wall. The three slots of the group 5 of slots in each side wall 2 are greater in length than the three slots of the first or upstream group 4 of slots in each side wall; the three slots of the group 6 of slots in each side wall are greater in length than the three slots of the group 5 of slots; the three slots of the group 7 of slots in each side wall are greater in length than the three slots of the group 6 of slots; and the three slots of the group 8 of slots in ea:h side wall are greater in length than the three slots of the group 7 of slots. As will be seen on referring to FIG. 1, the end walls of each slot of each group 4, 5, 6, 7 and 8 of slots is of substantially semi-circular shape.

The side walls 2 of the buffer structure 1 are secured to the rails R of the permanent track at spaced positions along the length of the side walls by five pairs 14, 15, 16, 17 and 18 of transversely spaced two-part clamps 21. Each two-part clamp 21 of each pair 14, 15, 16, 17 and 18 of clamps comprises two plates 22 which are disposed on opposite sides of one side wall 2 of the buffer structure 1 and are clamped in direct contact with opposite sides of the adjacent rail R. Each side plate 22 of each two-part clamp 21 of each pair 14, 15, 16, 17 and 18 of clamps has three longitudinally spaced, transversely extending lugs 24 of semi-circular cross-section (see FIG. 3) which pass through the three slots of one of the groups 4, 5, 6, 7 and 8 of slots with which the pair of clamps is associated and whose flat diametrical faces co-operate with the flat diametrical faces 27 of the semi-circular lugs 24 of the other side plate 22 of the two-part clamp to form two-part lug units of circular cross-section. As will be seen on referring to FIG. 3, the cooperating flat diametrical faces 27 of the lugs 24 of semi-circular shape when the Y abut lie in a plane that is approximately parallel to the plane containing the uppermost surfaces of the rails R of the permanent track.

Extending through each two-part lug of circular cross-section formed by the co-operating lugs 24 of semi-circular cross-section is a bore 25 inclined at an acute angle to the axis of the two-part lug of circular cross-section and substantially parallel to the direction of the force to be imparted on the side plates 22 to clamp them to the rail R. Clamping bolts 2 (FIG. 1) pass through the bores 25 in the two-part lugs of circular cross-section of each two-part clamp of each pair 14, 15, 16, 17 and 18 of clamps to clamp the side plates 22 of the clamp in direct contact with opposite sides of the adjacent rail R.

Figure 3:
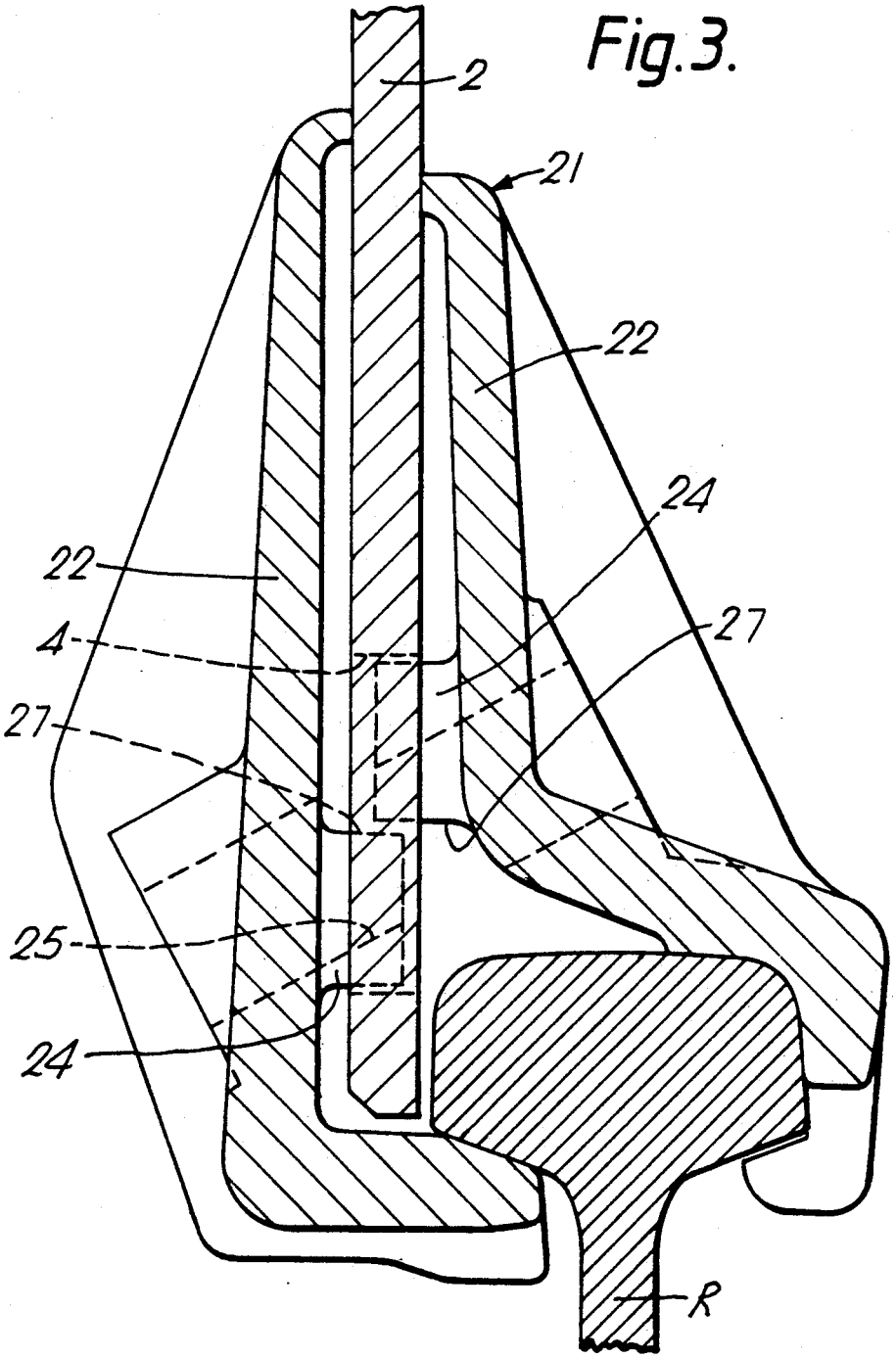
FIG. 3 is a cross-sectional view of one side wall and one two-part clamp of the preferred buffer stop taken on the line III—III in FIG. 2.
Figure 4:
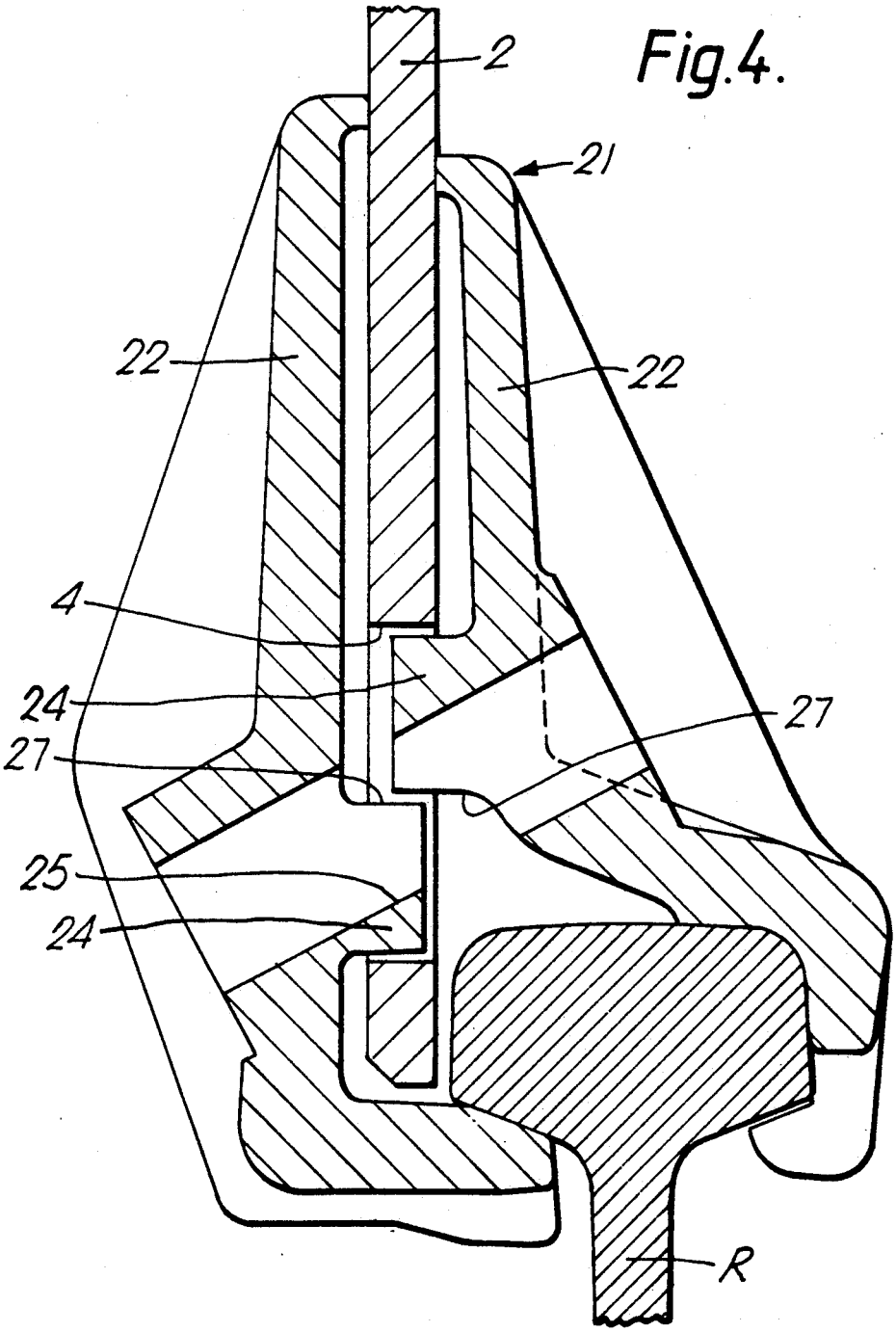
FIG. 4 is a cross-sectional view of one side wall and one two-part clamp of the preferred buffer stop taken on the line IV—IV in FIG. 2.

For sake of clarity, in FIGS. 3 and 4, clamping bolts 26 have been omitted and the flat diametrical faces 27 of the lugs 24 are shown spaced apart; when the clamping bolts are tightened, the flat diametrical faces of the lugs will abut.

The longitudinal spacing of the lugs 24 of semi-circular cross-section of the two-part clamps of each pair 14, 15, 16, 17 and 18 of clamps is such that, when the buffer stop is installed, the clamps can be clamped to the rails R with the two-part lugs of circular cross-section of the clamps directly abutting the downstream end walls of the slots of that one of the groups 4, 5, 6, 7 and 8 of slots with which the pair of clamps is associated.

On impact of a train with the preferred buffer stop, the side walls 2 of the buffer structure 1 move a first predetermined distance with respect to the rails R of the permanent track so that the upstream end walls of the slots of the first or upstream group 4 of slots engaged by the two-part lugs of circular cross-section of the two-part clamps of the first or upstream pairs 14 of clamps will directly abut the lugs to cause the side plates 22 of the clamps of the first pair 14 of clamps to slide with respect to the rails R and to cause the energy of the train to be absorbed by frictional resistance between the relatively sliding contacting surfaces of the rails and side plates of the clamps. The side walls 2 of the buffer structure 1 move at least one further predetermined distance with respect to the rails R of the permanent track, which further predetermined distance is of a greater length than the preceding predetermined distance, so that the upstream end walls of the slots of the second groups 5 of slots engaged by the two-part lugs of circular cross-section of the two-part clamps of the second pairs 15 of clamps will directly abut the lugs to cause the side plates 22 of the clamps of the second pairs 15 of clamps to slide with respect to the rails of the permanent track and to cause further energy of the train to be absorbed by frictional resistance between the relatively moving contacting surfaces of the rails and side plates of the pairs 15 of clamps in addition to that being absorbed by the frictional resistance between the relatively moving contacting surfaces of the rails and side plates of the preceding pairs 14 of clamps. If necessary, further energy of the train will be absorbed in the same way and in sequential addition by the groups 6 of slots and associated pairs 16 of clamps, by the groups 7 of slots and associated pairs 17 of clamps and by the groups 8 of slots and associated pairs 18 of clamps.

What I claim as my invention is:

1. A buffer stop for use on a permanent track of a railway comprising a buffer structure including a pair of transversely spaced side walls each adapted to extend lengthwise of and adjacent to one rail of the permanent track and having spaced from the lowermost edge a plurality of slots mutually spaced along the length of the side wall, each slot of one side wall extending substantially parallel to the adjacent rail and being directly opposite to and of substantially the same length as a substantially identical slot in the other side wall, and a plurality of pairs of transversely spaced two-part clamps for detachably securing the side walls of the buffer structure to the rails of the permanent track at spaced positions along the lengths of the side walls, each two-part clamp of each pair comprising a pair of plates which are disposed on opposite sides of one side wall of the buffer structure and are adapted to be clamped in direct contact with opposite sides of the adjacent rail by at least one clamping bolt which passes through one of the mutually spaced slots in said wall, the slots engaged by the bolts of the two-part clamps of each pair of clamps being substantially identical in length and the slots engaged by the bolts of the two-part clamps of each pair of clamps, except a first and upstream pair of clamps at an upstream end of the buffer structure, being greater in length than the slots engaged by the bolts of the two-part clamps of an adjacent upstream pair of clamps; whereby, on impact of a train with the buffer stop, the side walls of the buffer structure will move a first predetermined distance with respect to the permanent track so that the upstream end walls of the slots engaged by the bolts of the two-part clamps of the pair of clamps at said upstream end of the buffer structure will abut said bolts to cause the side plates of said two-part clamps to slide with respect to the rails of the permanent track and to cause the energy of the train to be absorbed by frictional resistance between the relatively sliding contacting surfaces of the rails and side plates of the clamps, and the side walls of the buffer structure will move at least one further predetermined distance with respect to the permanent track, so that the upstream end walls of the slots engaged by the bolts of the two-part clamps of each succeeding pair of clamps will abut said bolts to cause the side plates on said succeeding pair of clamps to slide with respect to the rails of the permanent track and to cause further energy of the train to be absorbed by frictional resistance between the relatively moving contact surfaces of the rails and side plates of said succeeding pair of clamps in addition to that being absorbed by the frictional resistance between the relatively moving contacting surfaces of the rails and side plates of each preceding pairs of clamps.

2. A buffer stop as claimed in claim 1, wherein each of the slots in each side wall of the buffer structure through which a clamping bolt passes is of such a length that, when the buffer stop is initially installed and before impact by a train, each bolt is in contact with the downstream end of the slot in which it is engaged.

3. A buffer stop as claimed in claim 1, wherein each two-part clamp of each pair of clamps detachably securing the associated side wall of the buffer structure to the rails of the permanent track has a plurality of bolts mutually spaced along the length of the clamp and passing through a like plurality of mutually spaced holes in the side wall of the structure, each of the same length as one another, so that, when impact of a train with the buffer stop occurs and the side walls of the buffer structure move with respect to the permanent track, the upstream end walls of said plurality of slots abut the bolts passing therethrough simultaneously.

4. A buffer stop as claimed in claim 1, wherein at least one of the side plates of each two-part clamp of each pair of clamps has at least one transversely extending lug which passes through a slot in the associated side wall of the buffer structure and engages with the other side plate of said clamp and said clamping bolt passes through a transversely extending bore in said lug so that, when the side walls of the buffer structure move with respect to the permanent track when a train makes impact with a buffer stop, the upstream ends of said slots in the side walls will make direct contact with the transversely extending lugs of the clamps through which the clamping bolts pass.

5. A buffer stop as claimed in claim 4, wherein said at least one transversely extending lug of each two-part clamp of each pair of clamps is of substantially semi-circular cross-section.

6. A buffer stop as claimed in claim 4, wherein said at least one transversely extending lug of each two-part clamp of each pair of clamps is of substantially semi-circular cross-section and the upstream end wall of the slot through which the lug passes is of corresponding substantially semi-circular shape.

7. A buffer stop as claimed in claim 5, wherein each said side plate of each two-part clamp of each pair of clamps has at least one transversely extending lug of substantially semi-circular cross-section which passes through a slot in the associated side wall of the buffer structure and a flat diametrical face of the lug of one side plate abuts a flat diametrical face of the lug of the other side plate of the clamp to form a lug unit of substantially circular cross-section.

8. A buffer stop as claimed in claim 7, wherein the abutting flat diametrical faces of the lugs of semi-circular shape lie in a plane that will be approximately parallel to the plane containing the uppermost surfaces of the rails of the permanent track.

9. A buffer stop as claimed in claim 4, wherein the axis of the transversely extending bore in said at least one lug through which the clamping bolt passes is inclined at an acute angle to the axis of the lug and substantially parallel to the direction of the force to be imparted on the side plates to clamp them to the rail.

* * * * *